United States Patent [19]
Wolff

[11] Patent Number: 4,469,076
[45] Date of Patent: Sep. 4, 1984

[54] LIQUID FUEL TREATMENT APPARATUS

[76] Inventor: Carl Wolff, 804 Cherry, Henderson, Nev. 89015

[21] Appl. No.: 413,219

[22] Filed: Aug. 30, 1982

[51] Int. Cl.³ ..... F02M 27/00
[52] U.S. Cl. ..... 123/538; 123/536; 210/222
[58] Field of Search ..... 123/536, 537, 538, 539; 210/222, 695

[56] References Cited

U.S. PATENT DOCUMENTS

| | | | |
|---|---|---|---|
| 3,116,726 | 1/1964 | Kwartz | 123/538 |
| 3,186,549 | 6/1965 | Botstiber | 210/222 |
| 3,228,868 | 1/1966 | Ruskin | 210/222 |
| 3,349,354 | 10/1967 | Miyata | 123/538 |
| 3,680,705 | 8/1972 | Happ | 210/222 |
| 3,830,621 | 8/1974 | Miller | 210/222 |
| 4,050,426 | 9/1977 | Sanderson | 123/538 |
| 4,173,206 | 11/1979 | Masaki | 123/538 |
| 4,381,754 | 5/1983 | Hechel | 123/538 |

FOREIGN PATENT DOCUMENTS

| | | | |
|---|---|---|---|
| 912719 | 12/1962 | United Kingdom | 210/222 |
| 1439175 | 6/1976 | United Kingdom | 210/222 |
| 0649441 | 4/1979 | U.S.S.R. | 210/222 |

*Primary Examiner*—Ronald H. Lazarus
*Attorney, Agent, or Firm*—Seiler, Quirk & Tratos

[57] ABSTRACT

Apparatus for improving fuel utilization efficiency of an internal combustion engine comprises an elongate device for mounting in a liquid fuel line having a plurality of radially spaced longitudinal bores in a solid plastic housing communicating with an inlet and outlet. Aligned magnets are retained in shallow axial cavities at each end of the housing. The device is energized by placement between a pair of electrodes having a high voltage for several hours.

6 Claims, 5 Drawing Figures

LIQUID FUEL TREATMENT APPARATUS

BACKGROUND OF THE INVENTION

This invention relates to device for increasing fuel economy in an internal combustion engine. More particularly, the invention relates to a device for mounting in the liquid fuel supply line of a vehicle and which modifies the surface tension and interfacial tension properties of the fluid, thus providing improved atomization of the fuel in the combustion chamber.

Increased fuel utilization in internal combustion engines has been a much sought after, though somewhat elusive, goal. Ever since the initial commercialization of internal combustion engines, thousands of different designs of carburetors, fuel injection devices, engine operating conditions, types of fuel, and engine designs have been investigated in an effort to optimize engine efficiency. Despite the millions of dollars invested in research and development of these engines, current commercial vehicles operate at a relatively low energy efficiency rate.

In recent years much emphasis has been placed on the fuel saving effectivenss of driving a vehicle 55 miles per hour rather than previously higher legal speeds. For many cars, the slower vehicle speed equates to a lower number of revolutions per minute for the engine which, in turn, extends the duration of the compression cycle of the engine. A longer compression time permits much more complete vaporization of fuel in the cylinder prior to ignition. More complete vaporization yields a lower fuel consumption necessary to maintain the lower speed. However, vaporization is still not complete even at 55 mph, and in traffic or other acceleration situations, an engine may run at higher revolutions per minute in lower gears and still suffer less complete vaporization.

The device of the invention affects the fuel in much the same manner as if a surfactant, e.g., a wetting agent, has been added to the fuel, thereby reducing the interfacial tension of the liquid. Reduction of the interfacial tension in the liquid will allow more complete vaporization for any unit of time, and will diminish the droplet size of any non-vaporized fuel. Both of these factors produce a more complete oxidation of the fuel, and therefore, contribute to improve fuel economy. While the apparatus of the invention has been shown to be effective in unbiased tests, the reason that the device operates in this manner is not well understood.

Accordingly, it is an object of the present invention to provide a device for attaching in the fuel line of a vehicle having an internal combustion engine which increases the fuel efficiency of the engine. It is another object of the invention to provide apparatus for treating liquid fuel to effect the properties of the liquid to provide more complete vaporization in the combustion chamber. It is yet a further object of the invention to provide a device for treating liquid fuel which reduces the surface tension and interfacial tension properties of the liquid. These and other objects of the invention will be apparent from the following detailed description of a preferred embodiment of the invention.

BRIEF SUMMARY OF THE INVENTION

Apparatus for increasing fuel economy in an internal combustion engine adapted to be mounted in the liquid fuel inlet line comprises an elongate cylindrical housing having a plurality of eccentric parallel lengthwise bores therethrough, a shallow axial cavity located at each end of the housing, and a magnet contained in each cavity with the magnets having pole aligned with each other. Each end of the housing is enclosed with a threaded cap which also forms a collection chamber for liquid passing through the bores at each end of the unit. A single axial bore in each cap serves as an outlet for the unit, and threaded connectors at each end which fasten to the cap are used to attach the unit in the fuel line of the vehicle. Prior to use, the unit is "energized" by placing the unit between two parallel metal plates maintained at a 15,000 v potential differential for a period of 12 hours.

BRIEF DESCRIPTION OF THE DRAWINGS

The invention is best understood with reference to the drawings, in which.

DETAILED DESCRIPTION OF A PREFERRED EMBODIMENT

Figure 1:
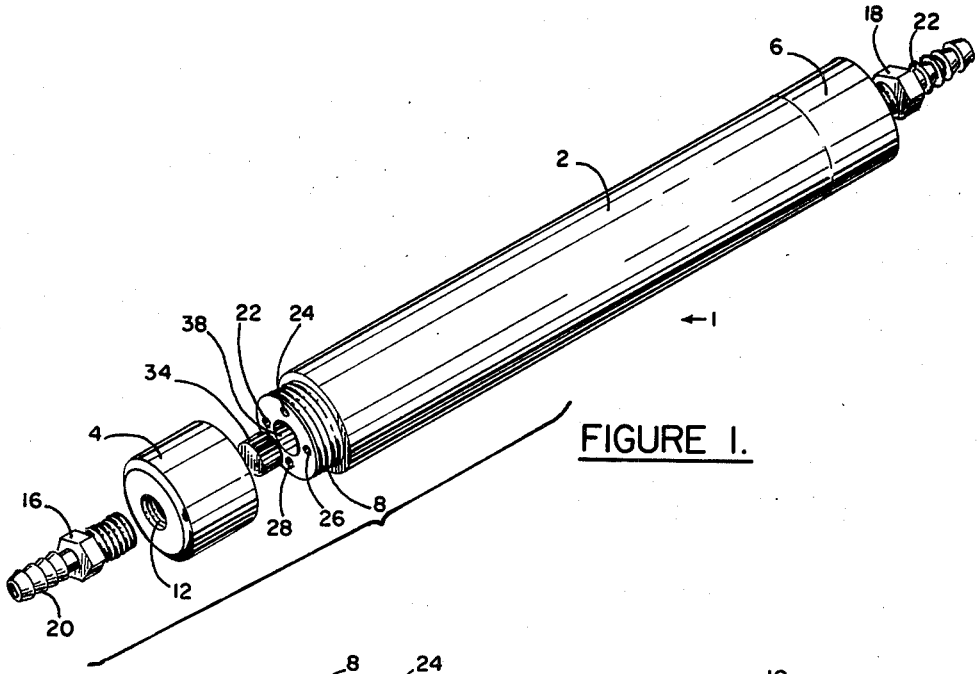
FIG. 1 is a partially exploded view of a fuel economizer of the invention.
Figure 2:
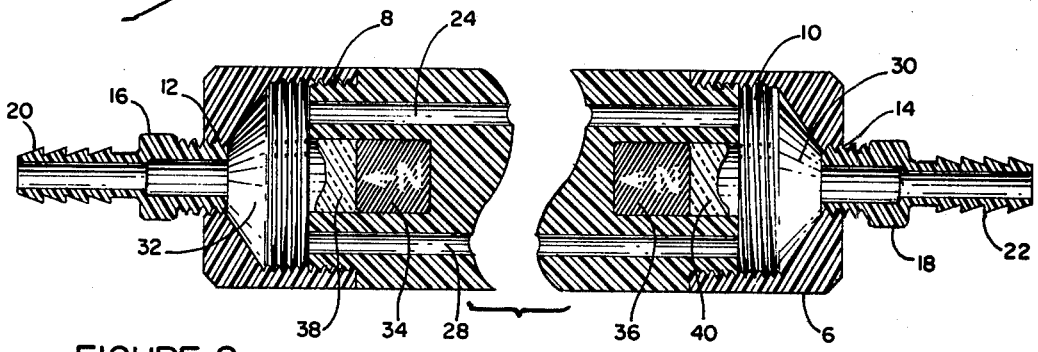
FIG. 2 is a partial side section view thereof.

Referring to FIGS. 1 and 2, the fluid fuel treatment device 1 of the invention comprises a plastic housing 2 which is a solid cylindrical unit enclosed by threaded caps 4 and 6 at the outlet and inlet end, respectively. While a variety of materials may be used for the housing, it is essential that the material not have any magnetic properties, and that it be not affected in any way by fuel or hydrocarbon oils. Each end of the housing is equipped with a male threaded portion 8 and 10 of slightly reduced diameter, but when the caps 4 and 6 are in place, the entire unit is of substantially uniform exterior diameter. The caps have internal threads 12 and 14 for engaging the threaded portions of the housing. The housing as shown is approximately 2" in diameter and 12" long; another model $1\frac{1}{2}$ diameter×9" has also proven effective.

A plurality of bores 22, 24, 26, and 28 which extend lengthwise through the entire length of the housing are located at 90° intervals radially from the cylinder axis. The bores have a narrow diameter of approximately 5/16". When the caps are in place, the entire unit has an overall length of about $13\frac{1}{4}$".

The internal portion of the caps 4 and 6 is tapered toward the end of the cap to form a frusto-conical shaped chamber at each end of the unit. As shown in FIG. 2, the inlet section of the unit as an inlet liquid fuel chamber 30, and the outlet has a corresponding outlet chamber 32. Fuel enters the unit through a hose fitting 18 which is threadedly engaged in a bore 14 axially located in the cap. A similar fitting 16 is threadedly mounted in bore 12 of cap 4. Ribbed nipples 20 and 22 on fittings 16 and 18, respectively, serve as connecting means for fastening the unit to the liquid fuel line of the vehicle. The unit is generally attached just downstream of the fuel tank, before the fuel pump and always before the fuel inlet or fuel vaporization mechanism of the vehicle.

A shallow axial cavity 40 having a $\frac{1}{2}$" diameter and a 1" depth is located at the inlet end of the housing. A similar cavity of the same dimensions 38 is located at the outlet end of the housing. Polar ceramic magnets having a nominal exterior diameter of about $\frac{1}{2}$" and a thickness of about ¼" are located in the cavity. The magnets are aligned as shown in FIG. 2 with the north poles of each magnet pointing to the outlet end of the housing. The magnets are Alnico magnets available from Magnetic Sales and Manufacturing Company as Grade 1 ceramic magnet part no. 42A5025. The magnets may be held in by friction if properly sized, or may be held in with any sort of adhesive or glue.

Figure 3:
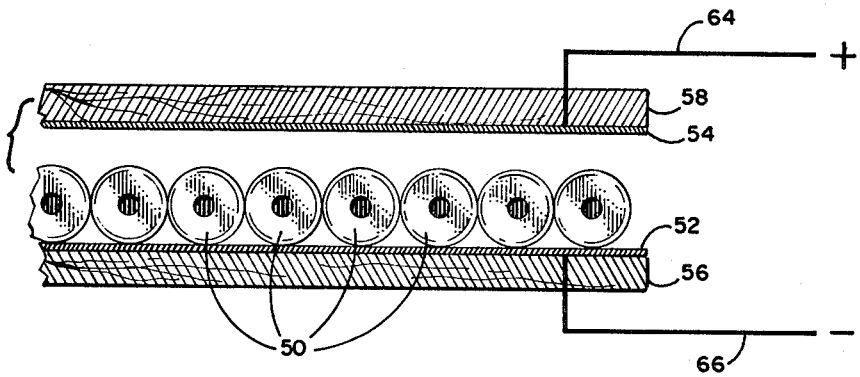
FIGS. 3 and 4 are schematic diagrams showing the method of energizing units of the invention.
Figure 4:
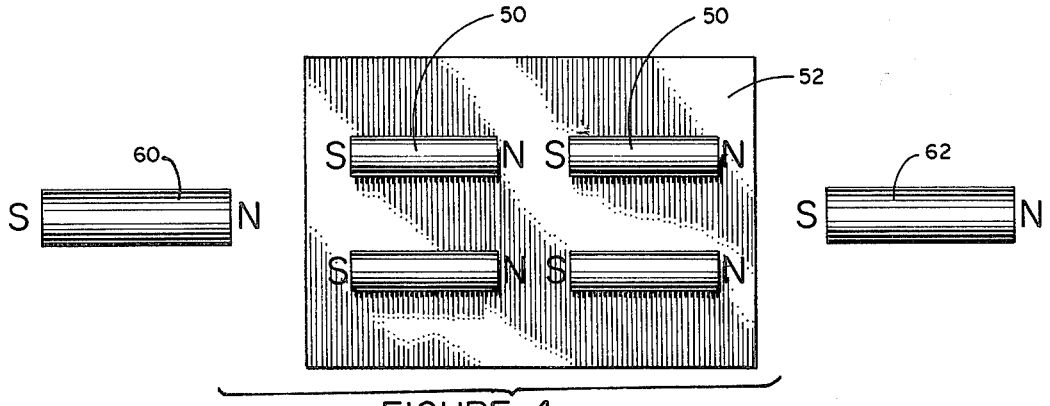

Prior to utilization, the units of the invention are energized as hereinafter described. As shown schematically in FIGS. 3 and 4, the units are placed on a 4' by 4' aluminum plate 52 mounted on frame 56. A second aluminum plate 54 mounted on a frame 58 and having the same size and dimensions as the lower plate is maintained in a parallel position 3" above the lower plate. Electrical leads 64 and 66 connected to the upper and lower plates, respectively, are connected to a 15,000 v electrical source (not shown). A plurality of units 50 are placed on the bottom plate 52 for energizing. As shown in FIG. 4, which is a schematic top view of a few of the units to be energized with the upper plate removed, a pair of very strong magnets 60 and 62 are maintained 6" inches away from the edge of the tray holding the units. The magnets 60 and 62 are 3" in diameter and 15" long, with a strength of about 1 kilogauss. These magnets are cast Alnico 5 round magnets commercially available from Magnet Sales and Manufacturing Company as part No. RR64-15.00. Magnet properties are:

retentivity = 12,500 gauses coercive force = oersteds maximum energy product, $\times 10^6 = 5.25$ induction at maximum energy product = 10,000 gauses The units are energized by maintaining the units with all of the magnets having their poles aligned as shown in FIG. 4 under a relatively high electrical potential for a relatively long period of time. An electrical potential is maintained across the aluminum plates as shown in FIG. 3 of about 15,000 v, or more for a period of at least twelve hours. The units are then ready for use.

Figure 5:
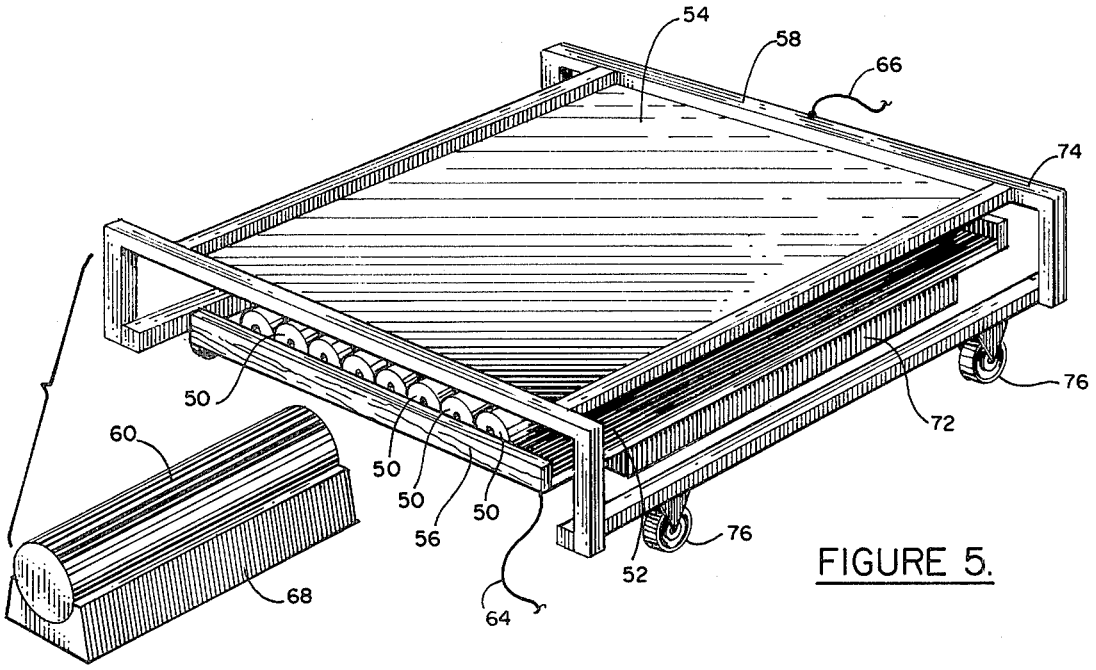
FIG. 5 is a perspective view of a charging apparatus for devices of the invention.

A relatively simple apparatus useful for energizing the units of the invention is shown in FIG. 5. A rectangular wood base 72 is floor mounted and supports a separate plywood tray which holds the units to be energized. The plywood tray is 4' by 4' by ½", and has 2" high rails at either end to maintain the units in place. A piece of aluminum sheet metal 4' by 4' by ⅛" is bolted to the inside portion of the plywood base. The units 50 are then placed on the sheet metal, with the internal magnets and housing aligned. A portable frame 74 is supported by a plurality of wheels 76 is then rolled into place over the tray containing the units to be energized. The rectangular portion of the frame 58 has a sheet of aluminum bolted to the frame. Electrical leads 64 and 66 from the lower and upper aluminum sheets, respectively, are then attached to a 15,000 v. power source (not shown). A pair of cast Alnico 5 magnets 60 and 62 are then oriented at the same vertical level as the units to be energized, and approximately midway along the tray, during the energizing process. Each magnet 60 and 62 is supported by a wood base, shown as base 58 for magnet 60. Magnet 62 is not visible in FIG. 5, but is supported by a similar base. Electrical leads are then connected to the power source and energized, and the voltage differential is maintained across the two aluminum plates for a period of about 12 hours. After the energizing process is complete, the units are ready for use. In one embodiment of the energization process, the entire energizing apparatus as shown in FIG. 5 was placed under a pyramid-shaped structure fabricated from ⅜" brass rod doweling. The pyramid had an 8' square base and 8' long edges, and consisted of a frame constructed from 8' brass rods which extended from the corners of the base to the apex. The entire energizing apparatus was placed under this structure, and improved results were noted.

The following table illustrates the decrease in interfacial tension in various common fluids after passing the fluids through a unit of the invention. and with sufficient pressure to force the fluid through the unit. The table illustrates the number of milliliters of fluid per 100 drops of fluid before and after treatment with the unit.

TABLE I

| | ml/100 drops (avg.) | |
|---|---|---|
| | Untreated | Treated |
| Water | 5.7 | 5.43 |
| Glycerine | 4.2 | 3.6 |
| Jet Fuel | 2.4 | 2.33 |
| Automobile Gasoline | 2.4 | 2.25 |

The following Example illustrates an actual test of the device of the invention.

EXAMPLE 1

A test was run under controlled conditions by an independent engineering firm to determine the efficacy of the fuel cartridges of the invention. The test was run using a 1979 Dodge Magnum 360 CID V8 automobile. The test used to measure performance is the EPA Highway Fuel Economy Test (HFET). The test is run in a controlled ambient cell where temperature and other conditions are maintained within specified limits. During the HFET, the vehicle is driven on a chassis dynamometer over a driving schedule having an average speed of 48.2 mph. Through the use of flywheels and a water brake, the loads that the vehicle would actually see on the road are reproduced. The vehicle's exhaust is collected, diluted, and thoroughly mixed with filtered background air to a known constant volume flow, using a positive displacement. This procedure is known as constant volume sampling (CVS). The HFET captures the emissions generated during 10.242 miles of driving.

A Chancey Dynamometer reproduces vehicle inertia with fly wheels and road load with a water brake. Inertia is available in 125 pound increments between 1750 pounds and 6950 pounds. For each inertia weight class, a road load is specified which takes into account rolling resistance and aerodynamic drag for an average vehicle in each class.

The driver follows a controlled driving schedule which is patterned to represent average highway driving. The driving schedule is displayed to the driver of the test vehicle to match the vehicle speed to that displayed on the schedule. The fuel economy of the test vehicle is calculated from the exhaust emissions data using the carbon atom balance technique. The procedure followed in this test is found in the Federal Register, Vol. 37, No. 221, Part II, Nov. 15, 1972. In this particular case, the test fuel and mileage accumulation fuel was an unleaded, 87 octane summer grade fuel.

The test results are presented in tabular form below. Results are presented for a baseline condition, an immediate condition using a treating device of the invention, and a condition using the treating device of the invention for 275 miles of driving.

TABLE II

| Test Description | MPG | Emissions (gm/mile) HC | CO | NO | $CO_2$ |
|---|---|---|---|---|---|
| Baseline condition without treating device | 18.34 | .194 | 1.22 | 1.92 | 481.05 |
| Using treating device without mileage accumulation | 19.38 | .085 | .13 | 1.60 | 457.38 |
| Using treating device after 275 miles of driving | 19.35 | .071 | .21 | 1.23 | 458.0 |

It can be seen from the table that a significant increase in miles per gallon occurred using the device of the invention, and objectionable emissions, e.g. hydrocarbons, carbon monoxide, and nitrogen oxides decreased substantially. Other empirical tests of the device of the invention on various automobiles have indicated increases in fuel economy up to 25%.

EXAMPLE 2

A sample of regular unleaded automotive gasoline was tested to determine surface tension and interfacial tension, and was then passed through the treating apparatus of the invention and retested. The results were as follows:

TABLE III

| | Untreated Sample | Treated Sample |
|---|---|---|
| Surface Tension dynes/cm at 25° C. | 20.1 | 20.0 |
| Interfacial Tension dynes/cm at 25° C. | 36.6 | 15.3 |

It can be seen from the results of the table that the interfacial tension decreases substantially by treatment with the unit of the invention. This would be expected to result in substantially increased ability to vaporize liquid.

I claim:

1. In a vehicle powered by an internal combustion engine having a liquid hydrocarbon fuel reservoir and a fuel inlet line extending between the engine and the fuel source, the improvement therein which comprises fuel treatment apparatus mounted in the fuel inlet line comprising an elongate plastic housing having a plurality of eccentric lengthwise bores therethrough oriented at 90° radial spacing around a longitudinal housing axis, a shallow axial cavity adjacent each end of the housing, and a cylindrical magnet contained in each cavity, said magnets having poles aligned with the North poles thereof directed toward the outlet end of the housing.

2. The apparatus of claim 1 also comprising a fluid inlet at one end of the housing, a fluid outlet at an opposite end thereof, a fluid inlet chamber interior of the housing communicating with the fluid inlet and the lengthwise bores, and a fluid outlet chamber interior of the housing communicating with the fluid outlet and the lengthwise bores.

3. The apparatus of claim 1 wherein the housing is a solid nylon cylinder.

4. The apparatus of claim 1 wherein the apparatus has been energized by placement between two electrodes across which is maintained a high-voltage potential.

5. The apparatus of claim 4 wherein the apparatus has been energized by placement between two electrodes having an electrical potential therebetween of about 15,000 volts for at least about 12 hours.

6. The apparatus of claim 4 or 5 wherein the energization occurs in the presence of a second pair of magnets having their poles aligned with the magnets contained in the housing cavities.

* * * * *